United States Patent [19]

Moody

[11] Patent Number: 4,840,045

[45] Date of Patent: Jun. 20, 1989

[54] JEWELRY MOUNTING CONSTRUCTION

[75] Inventor: Leonardo Moody, Downers Groove, Ill.

[73] Assignee: Luc-Co., Inc., Chicago, Ill.

[21] Appl. No.: 21,804

[22] Filed: Mar. 4, 1987

Related U.S. Application Data

[63] Continuation-in-part of Ser. No. 930,271, Nov. 14, 1986, abandoned, which is a continuation of Ser. No. 832,843, Feb. 4, 1986, Pat. No. 4,655,055, which is a continuation of Ser. No. 728,444, Apr. 30, 1985, Pat. No. 4,574,575, which is a continuation of Ser. No. 460,284, Jan. 24, 1983, abandoned.

[51] Int. Cl.[4] ..... A44C 7/00

[52] U.S. Cl. ..... 63/12; 63/20; 63/14.5; 63/29.1

[58] Field of Search ..... 63/20, 29 R, 14 D, 12, 63/13, 1 A, 1 R; 24/150 R, 155 R; 403/361; 156/294, 344; 29/DIG. 1, 10, 160.6; 411/303

[56] References Cited

U.S. PATENT DOCUMENTS

| | | | |
|---|---|---|---|
| 357,020 | 2/1887 | Nagle | 63/20 |
| 440,364 | 11/1890 | Perraud | 24/150 R |
| 569,053 | 10/1896 | Prokop | 63/20 |
| 738,542 | 9/1903 | Hunkins | 24/150 R |
| 2,257,002 | 9/1941 | Freeman | 63/20 |
| 2,285,051 | 6/1942 | Pujol | 63/20 X |
| 2,346,870 | 4/1944 | Post | 63/20 |
| 2,601,433 | 6/1952 | Cuccioli | 63/20 |
| 2,930,209 | 3/1960 | Altman | 63/20 X |
| 3,176,364 | 4/1965 | Dritz | 63/29.1 |
| 3,568,467 | 3/1971 | Ellison | 63/29 R |
| 3,605,438 | 9/1971 | Chalson | 63/12 |
| 3,789,850 | 2/1974 | Ford | 63/12 |
| 4,003,216 | 1/1977 | Cecere | 63/12 |
| 4,218,894 | 8/1980 | Tropea | 63/29 R |
| 4,353,225 | 10/1982 | Rogers | 63/29.1 |
| 4,574,595 | 3/1986 | Dritz | 63/29 R |
| 4,700,552 | 10/1987 | Haley | 63/12 |

FOREIGN PATENT DOCUMENTS

| | | | |
|---|---|---|---|
| 720335 | 5/1942 | Fed. Rep. of Germany | 63/12 |
| 821026 | 2/1956 | United Kingdom | 63/14.1 |

*Primary Examiner*—Richard J. Johnson

*Attorney, Agent, or Firm*—Allegretti & Witcoff, Ltd.

[57] ABSTRACT

An improved jewelry mounting construction for use in adapting pierced-ear earrings into earrings capable of being clamped on to unpierced ears. The improved construction comprises a clamping mechanism for securing a medium between opposed surfaces, one of those opposed surfaces being a receptacle for an earring post, with the receptacle having a means for securing the earring post of a pierced-ear earring therein. Also disclosed is a construction for using pierced-ear earring as lapel pins, having a post receptacle affixed to an apparel pin, with a means for securing an earring post in the receptacle.

3 Claims, 4 Drawing Sheets

Fig. 9
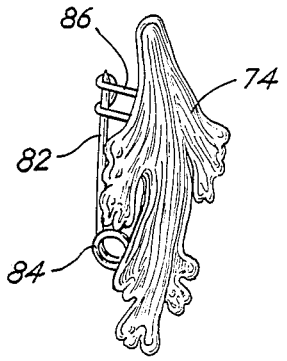
Fig. 10
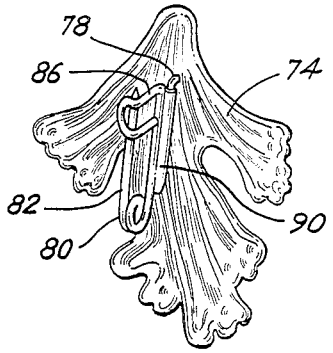
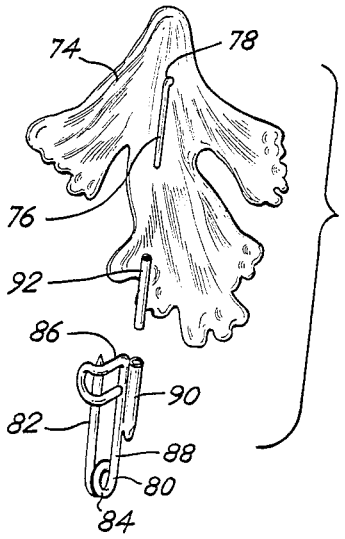
Fig. 11
Fig. 12
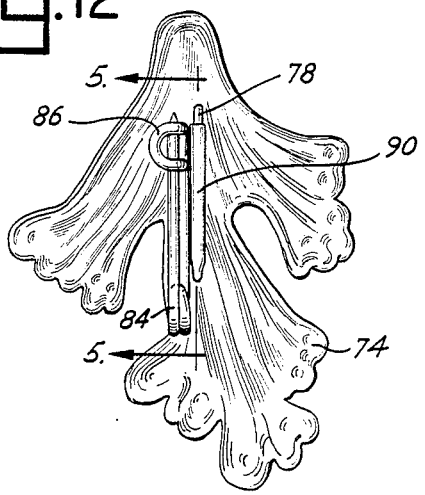
Fig. 13
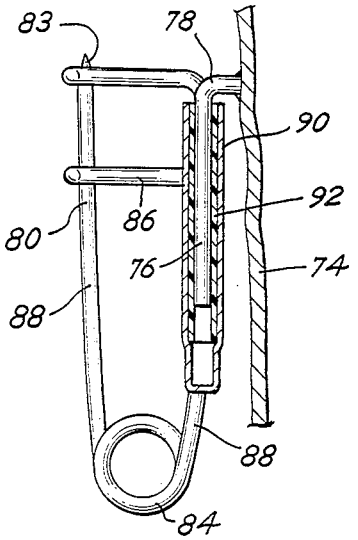

JEWELRY MOUNTING CONSTRUCTION

This application is a continuation-in-part of my earlier application Ser. No. 930,271 filed Nov. 14, 1986, now abandoned. Application No. 930,271 was a continuation of application Ser. No. 832,843 filed Feb. 4, 1986, now Pat. No. 4,655,055 which is itself a continuation of application Ser. No. 728,444, filed Apr. 30, 1985, now Pat. No. 4,574,595 which in turn is a continuation of application Ser. No. 460,284, filed Jan. 24, 1983, now abandoned.

BACKGROUND OF THE INVENTION

This invention relates to a jewelry mounting construction especially adapted for use with earring clamps and stickpins, and more specifically relates to a device for converting pierced-ear earrings into earrings capable of being clamped to unpierced ears, or worn as a stickpin or as a lapel pin.

Earrings have traditionally been available for use in pierced ears, or in unpierced ears. Pierced-ear earrings typically consist of a decorative object attached to a pin-like post; occasionally, pierced-ear earrings consist of a decorative object attached to a hooked pin or rod. When earrings are prepared with a post, they are conventionally secured to an earlob by inserting the post through a hole pierced through an earlobe, and thereafter clamping an anchor attachment onto the post behind the earlobe so that the earring post cannot be removed from the ear without removing the anchor form the earring post. Earrings produced for use on earlobes that are not pierced must employ some form of clamping means attached to a decorative object, with the clamping means used to affix the decorative object to an earlobe. Normally, pierced-ear earrings cannot be used on an ear that has not been pierced.

One aspect of the current jewelry industry is that the selection of pierced-ear earrings far exceeds the selection of earrings adapted for use on unpierced ears. Moreover, the majority of higher quality decorative earrings are of the pierced ear type. Hence, persons desiring to wear earrings, but unable or unwilling to have their ears pierced, have a more limited selection of earrings to choose from.

Stickpins are forms of jewelry normally consisting of a decorative object attached to a long rod or pin with a pointed end. The rod or pin is inserted through clothing, and secured underneath the clothing, thereby allowing a person's decorative jewelry to be displayed wherever a person choose. A limited selection of stickpins is, however, normally available. Moreover, stickpins are often sold as novelty items so that the quality of the decorative portion contained on a stickpin is often less than what an individual may desire. Lapel pins differ have features similar to stickpins, but in that the decorative object is attached near the center of a shorter pin, rather than the end of an elongated pin. Often, lapel pins use a spring loaded pointed end that can secured with a hook against the spring force to secure the pin or the wearer's apparel. Traditionally, lapel pins have the entire pin mechanism covered by the decorative object.

Before this invention, persons without pierced ears who desired to use the decorative portion of a pierced-ear earring in nonpierced-ear earrings, or as stickpins or lapel pins, were required to remove the decorative portion of the pierced-ear earring from the earring post or hook, and re-attach that decorative portion to a new clamp, such as the clamp disclosed in Saccoccio, U.S. Pat. No. 3,176,475 or to a stickpin. This is a delicate and somewhat tedious operation that usually can be accomplished only by a jeweler. Hence, persons desiring to use pierced-ear earring decorative portions have usually been required to take their chosen pierced-ear earrings to a jeweler for modification, with the delay and expense naturally attending to that action. Further, when decorative objects, such as diamonds, pearls, and delicately wrought precious metals, are removed from earrings, the operation, unless skillfully performed, may result in damage or disfiguration of the decorative portion of the earring.

An object of this invention is therefore to provide an improved jewelry mounting construction for securing a decorative item onto the body or any apparel.

A further object of this invention is to provide an improved jewelry mounting construction capable of attaching pierced-ear earrings on nonpierced ears, and capable of supporting the decorative portion of a pierced-ear earring without removing that decorative portion from the earring post.

Another object of this invention is to provide an improved jewelry mounting construction for use as a stickpin.

Still another object of this invention is to provide an improved jewelry mounting construction for use as a stickpin receptacle capable of receiving the post or straightened hook attached to the decorative portion of a pierced-ear earring.

Yet another object of this invention is to provide an improved jewelry mounting construction allowing a pierced-ear earring to be used as a lapel pin.

SUMMARY OF THE INVENTION

These and other objects of the invention are accomplished by providing an improved jewelry mounting construction usable with an earring clamp, stickpin or lapel pin. As an earring clamp, the mounting construction comprises a receptacle for receiving a pierced-ear earring post; in the preferred embodiment, the receptacle has a generally cylindrical bore in which the earring post may be inserted. The earring clamp also includes a means for securing the earring post in the receptacle bore, and a pincer jaw adapted to clasp an earlobe between the pincer jaw and the earring post receptacle. The clamping action of the improved earring clamp is provided by a leaf spring affixed to the pincer jaw, and is elastically operated through motion of a leaver attached to spanning arm between the receptacle and the pincer jaw. In the preferred embodiment, the means for securing the earring post in the post receptacle is an elastic material affixed to the interior of the post receptacle bore, so that insertion of the earring post compresses the elastic material and produces frictional resistance to sliding movement of the post within the post receptacle bore. In an alternative embodiment, the post receptacle is filled with an elastic material that is puncturable and yieldable, such as an elastomeric adhesive.

The objects of this invention are also accomplished with a stickpin embodiment comprising a elongated pin or rod with a pointed end, and a second end affixed to a tubular earring post receptacle. The earring post receptacle has a means for securing the earring post in the receptacle, and the stickpin further comprises a pin retention attachment mountable on the pin at the stickpin's pointed end, to secure the stickpin in place when the stickpin has been attached to clothing or the like. In the preferred embodiment, the means for securing the earring post in the post receptacle comprises an elastic material affixed within the center of the tubular post receptacle, so that insertion of the earring post into the post receptacle compresses the elastic material and produces frictional resistance to sliding movement of the earring post in the post receptacle.

The objects of this invention are also accomplished with a lapel pin embodiment comprising a pin structure affixed to a generally tubular earring post receptacle. The earring post receptacle has a means for securing the earring post in the receptacle. The pin structure allows the lapel pin to be secured to clothing or the like.

BRIEF DESCRIPTION OF THE DRAWINGS

Three embodiments of the present invention are disclosed in the detailed description and drawings. The drawings include 13 figures to illustrate the embodiments, wherein like reference numerals in each drawing refer to like parts of the various embodiments. The drawings are briefly described as follows:

FIG. 9 is a side perspective view of the invention used to convert pierced-ear earrings into lapel pins;

FIG. 10 is a rear perspective view of the lapel pin embodiment of FIG. 9;

FIG. 11 is an exploded rear view of the lapel pin embodiment of FIG. 9;

FIG. 12 is a rear view of the lapel pin embodiment of FIG. 9; and

FIG. 13 is a side cross-sectional view of the embodiment of FIG. 12.

In the detailed description, directional terms such as "upper", and "lower" and the like, are used to relate the invention to the earlobe of a person oriented in the normally erect position. Terms of this type are used for the convenience of the person of ordinary skill in the art, and are not to limit the scope of any patent issuing on the present invention, unless expressly included in the claims.

DETAILED DESCRIPTION OF THE PREFERRED EMBODIMENT

The present invention is a mounting construction for mounting jewelry on a persons body, or on an item of apparel. The jewelry is of the kind having a straight post for a support. Generally, the invention composes a receptacle for receiving the support post of a piece of jewelry, and an attachment means for attaching the receptacle and jewelry to a part of the body, or to apparel. The receptacle is connected to the attachment means by being affixed to a support stud affixed to the attachment means.

Figure 1:
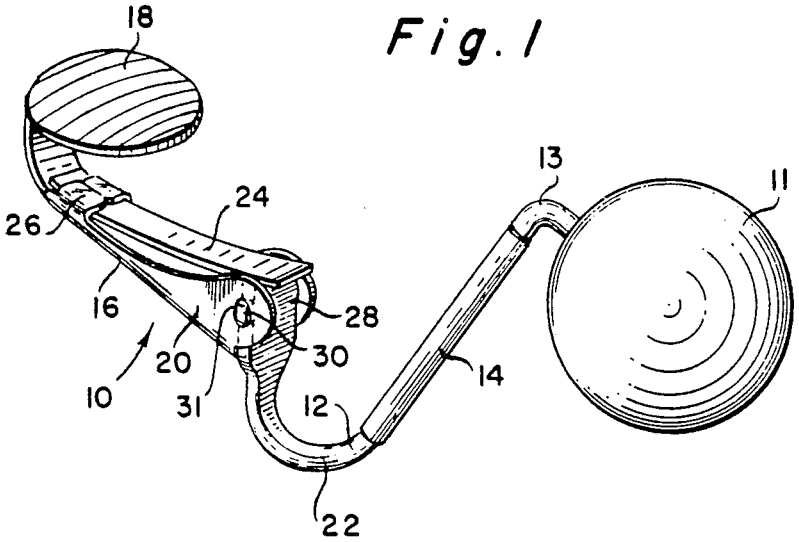
FIG. 1 is a side perspective view of the preferred embodiment of the invention depicting the improved earring clamp with a tubular earring post receptacle.
Figure 2:
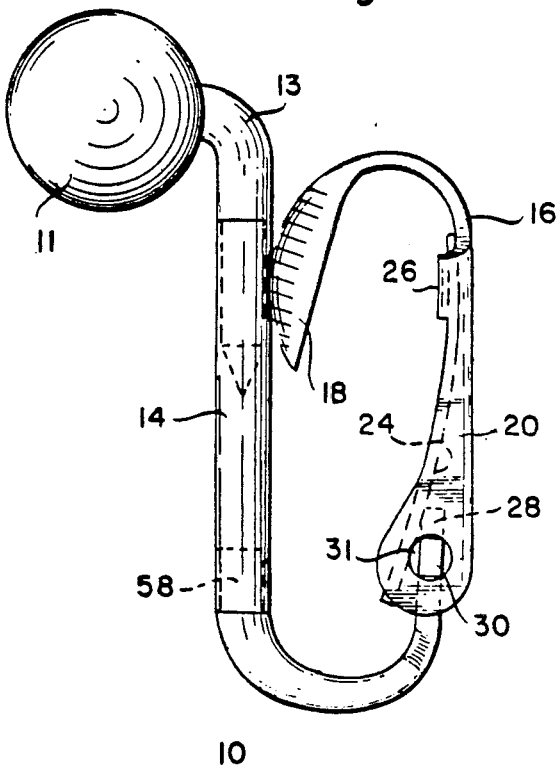
FIG. 2 is a side elevation of the earring clamp depicted in FIG. 1, showing operation of the leaf spring mechanism.
Figure 4:
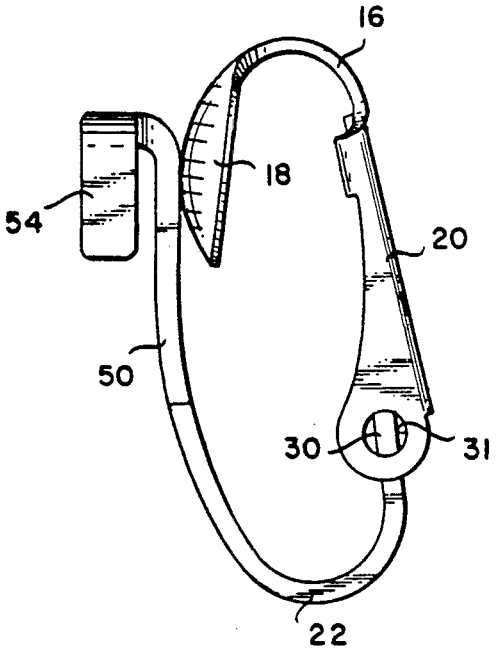
FIG. 4 is a side elevation of a second embodiment of the improved earring clamp.
Figure 5:
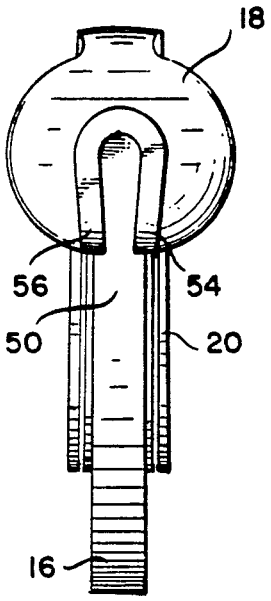
FIG. 5 is a front plan view of the second embodiment depicted in FIG. 4.
Figure 6:
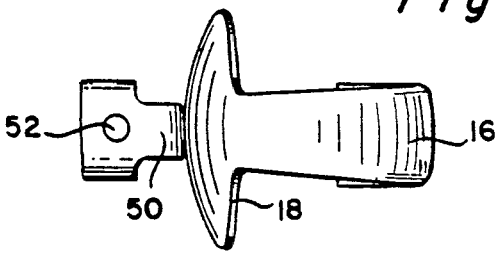
FIG. 6 is a top plan view of the second embodiment depicted in FIGS. 4 and 5.

Referring to FIGS. 1 and 2 of the accompanying drawings, a preferred embodiment of the present invention is incorporated in an earring clamp 10, so that the attachment means comprises a clamp for attaching jewelry to an earlobe. An alternative embodiment of the invention is shown in FIGS. 4, 5, and 6. The embodiment of FIG. 1 is regarded as the preferred mode of carrying out this invention. The earring clamp 10 is attached to a decorative jewelry piece 11, with a post 13.

The improved clamp can be set in two positions. The earring clamp 10 is shown in FIG. 1 in an open, or "cocked" position, and in FIG. 2 in a closed or "clamped" position. The earring clamp 10 includes a projecting stud 12, a post receptacle 14, and a pincer jaw 16. The pincer jaw 16 includes a contact surface 18 and a shank 20. The pincer jaw 16 is connected to the post receptacle 14 by a U-shaped spanning arm 22, the connecting portion of the spanning arm 22 being the projecting stud 12. The spanning arm 22 is inserted by the projecting stud 12 into the lower end of the post receptacle 14, and glued or soldered therein. The pincer jaw 16 with contact surface 18 and shank 20 comprises the attachment means for the mounting construction. The spanning arm 22 is the stud projecting from the attachment means and affixed to the receptacle, shown as post receptacle 14.

The earring clamp 10 is operated through use of a leaf spring 24. The leaf spring 24 is attached to the shank 20 at the shank's upper end by a clamp 26. The leaf spring 24 interacts with the spanning arm 22, both to secure the pincer jaw 16 in an open or "cocked" position, and to exert pressure by the contact surface 13 against an earlobe when the pincer jaw 16 is in the closed position on an ear.

The leaf spring 24 operates through pressure on a lever 28 extending from the spanning arm 22 as a continuation of spanning arm 22. The spanning arm 22 is pivotally connected to the pincer jaw 16 through axle arms 30 inserted through pivot holes 31. The leaf spring 24 exerts pressure on the lever 28, thereby acting to restrain the lever 28 in a position roughly parallel to the shank 20. When the lever 28 is rotated in the pivot holes 31, the lever 28 is restrained in a position perpendicular to the shank 20, thereby lifting the leaf spring 24 and "latching" the lever 28 against leaf spring 24. Latching occurs when the lever 28 is perpendicular to the leaf spring 24, so that leaf spring 24 cannot exert rotational force on the lever 28.

Figure 3:
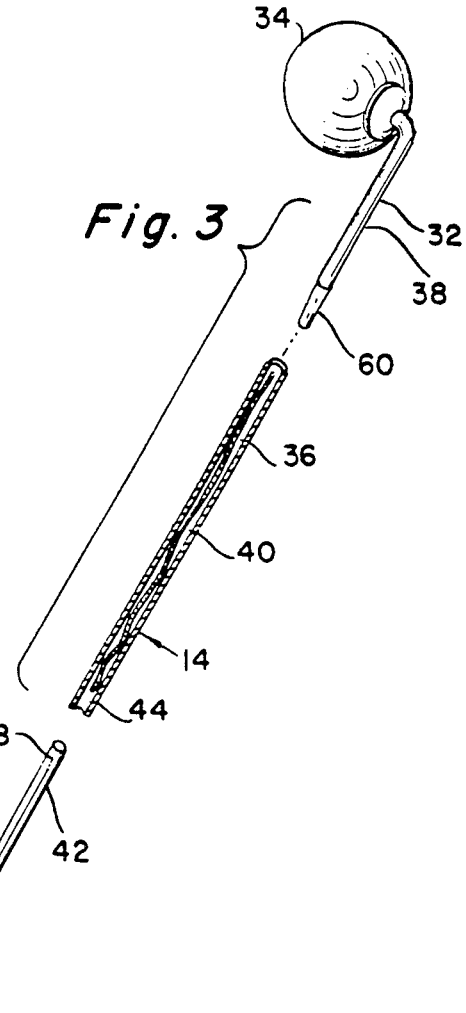
FIG. 3 is a cutaway, side perspective view of the tubular post receptacle, depicting how a pierced-ear earring with an earring post may be inserted into the post receptacle to form a stickpin.

Referring to FIG. 3, the post receptacle 14 is shown in cutaway, and before attachment of the post receptacle to an earring post. FIG. 3 also illustrates an earring post 32 attached to the decorative portion 34 of an earring. FIG. 3 further illustrates a means for releasable securing an earring post 32 within the post receptacle 14. In the preferred embodiment, that means comprises a portion of an elastic, compressible material 36 affixed to the inner surface of the post receptacle 14. In the preferred embodiment, the compressible material is a strand of flexible, compressible fiber, such as polyurathane or plastic fiber. In an alternative embodiment, the strand is a segment of flexible, compressible tubing, such as the polyurathane, plastic or rubber tubing used to insulate electrical wires. When a strand of tubing is used, the earring post fits within and compresses the tube. FIG. 3 shows that the earring post 32 may be inserted into the post receptacle 14, causing a friction fit between the outer surface 38 of an earring post and the inner surface 40 of the earring post receptacle. The compression fit also operates through interaction between the outer surface 38 of the earring post and the compressible material 36.

FIG. 3 further illustrates use of the invention as a stickpin. The attachment means is a pin 42 sized to be slidably inserted into the lower end 42 of the post receptacle 14. The pin 42 has a tapered or pointed end 46 so that the pin 42 may be used as the portion of a stickpin that is inserted through clothing or other puncturable material. The upper end 48 of the pin 42 comprises the projecting stud of the attachment means and is therefore insertable in the lower end 44 of the post receptacle. In the preferred embodiment, the upper end 48 is secured within the post receptacle by means of an adhesive bonding agent such as glue. In alternative embodiments, the upper end 48 of the pin 42 can be secured to the lower end 44 of the post receptacle 14 by means of solder, or an other securing means.

Referring to FIGS. 4, 5, and 6, an alternative embodiment is displayed for the post receptacle 14, particulary for use with earrings. FIG. 4 illustrates a side view of an alternative embodiment 50 of the post receptacle. That alternative embodiment consists of a body 50 attached to the spanning arm 22. As shown in FIG. 5 and FIG. 6, the body 50 has an upper end portion which is U-shaped and the bight of the U-shape defines an earring post hole 52 in which an earring post may be inserted. The earring post hole 52 is oriented so that an earring post inserted through the hole 52 will be aligned parallel to the shank 20 of the pincer jaw 16 when the clamp is in the closed position. As shown in FIG. 5, the legs of the U-shape at the end of body 50 are formed by opposed gripper arms 56 and 54 depending from the portion of the body 50 defining the hole 52. The gripper arms 54 and 56 are positioned in opposed relationship, so that when an earring post, such as that illustrated as 32 in FIG. 3, is inserted through the hole 52, the earring post 32 is aligned approximately parallel to the gripper arms 54 and 56, and is thereby gripped by the lower portions of the gripping arms 54 and 56, to secure the post 32 within the gripper arms 54 and 56.

FIGS. 4, 5, and 6 further illustrate that the alternative embodiment 12 of the earring clamp operates through clamping action upon an ear or other material, with that clamping action applied by the body 50 and contact surface 18 of the pincer jaw 16. As in the preferred embodiment, the alternative embodiment receives its clamping action through operation of a leaf spring (not shown) acting on the upper, pivot portion of the spanning arm 22. The pivot portion comprises a pivot hole 31 enclosing an axle arm 30. Again as in the preferred embodiment, the pincer jaw 16 may be latched in the open position, or the closed position as is shown in FIG. 4.

FIG. 3 further illustrates the method by which a pierced-ear earring may be converted to an earring suitable for use on unpierced ears, or to a stickpin. Considering FIG. 3 and FIG. 2, a method of converting pierced earrings begins by providing a clamp such as disclosed in FIG. 2; however, the clamp will not have the post receptacle 14, but would instead have an extended portion (not shown) of the spanning arm 22 constituting a clamping surface opposed to the contact surface 18. The extended portion of the spanning arm 22 is thereafter removed, leaving a clamp, such as is shown in FIG. 2, without the post receptacle 14. An earring post receptacle such as is shown in FIGS. 2 and 3 as 14 is then connected to the severed end 58 of the spanning arm 22. The earring post receptacle 14 is then securely affixed to the severed end 58 of the spanning arm 22, preferably by use of an adhesive bonding agent. Next, a means is provided for securing an earring post in the earring post receptacle 14. In the preferred embodiment, the means comprises a compressible material 36, such as a strand of polyurathane or plastic fiber, glued to the inner surface 40 of the post receptacle 14. The post receptacle 14 may also be sized for a simple friction fit between the outer surface 38 of the earring post and the inner surface 40 of the earring post receptacle. Thereafter, an earring must be prepared for insertion within the post receptacle 14, so that the decorative portion 34 of that earring may be properly displayed. In the preferred embodiment, this preparation comprises bending the earring post so that the decorative portion of the earring 34 is disposed away from the earring post 32. The preparation may also include tapering the lower end 60 of the earring post 32 to east insertion of the earring post 32 into the post receptacle 14. If the pierced-ear earring has a hook, rather than a post, the hook must be mechanically straightened to form a post.

Figure 7:
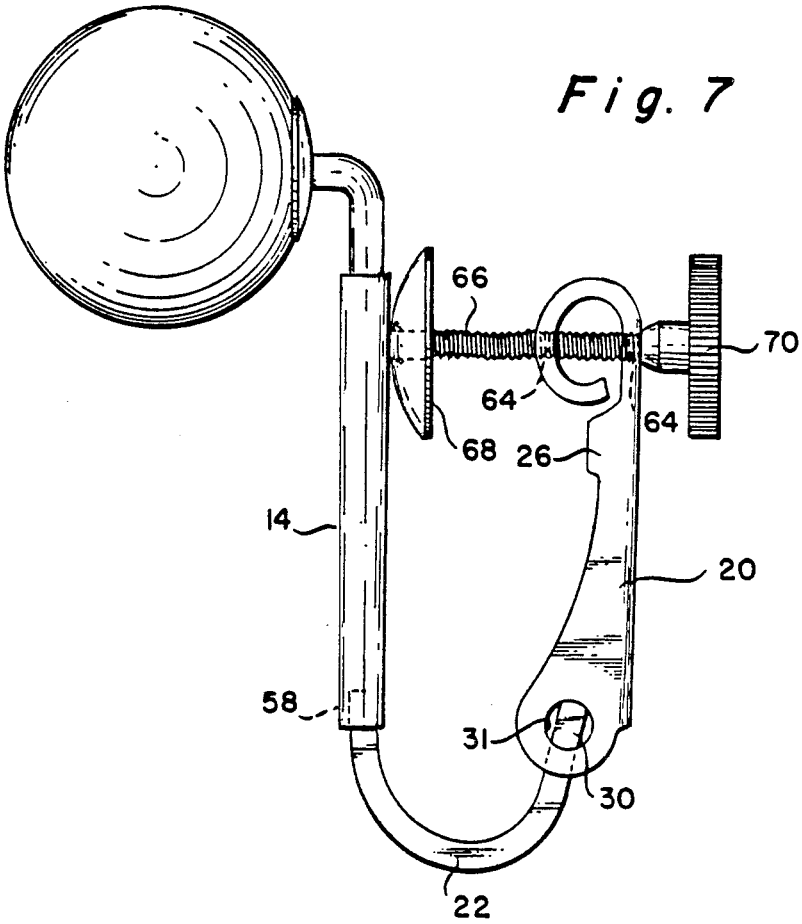
FIG. 7 is a side perspective view of a third embodiment of the improved earring clamp.

Referring to FIG. 7, a further alternative embodiment of the earring clamp is illustrated. Like the preferred embodiment, the embodiment illustrated in FIG. 7 contains a post receptacle 14 fixed to the severed end 58 of the spanning arm 22. Also as in the preferred embodiment, the alternative embodiment shown in FIG. 7 uses a lever 28 on the end of the spanning arm 22 interacting with the leaf spring to urge a shank 20 against the post receptacle 14; the leaf spring 24 is also attached to the shank 20 by a clamp 26, and the shank 20 rotates about axle arms 30 on the end of spanning arm 22, with the axle arms 30 extending through pivot holes 31 in the shank 20.

The alternative embodiment displayed in FIG. 7 differs from the preferred embodiment in that the upper end of the spanning arm 20 comprises a loop 62 pierced by a threaded bore 64 in the opposed sides of the loop. A tightening bolt 66 is threaded through the threaded bore 64 so that rotation of the tightening bolt urges the bolt towards or away from the post receptacle 14 when the shank 20 is in the closed position. A contact surface 68 is affixed to the tightening bolt 66 at its end nearest the post receptacle 14. A tightening handle 70 is affixed to the tightening bolt 66 at the tightening bolt's opposite end. In operation, manual rotation of the tightening handle 70 urges the tightening bolt 66 and contact surface 68 toward or away from the post receptacle 14, thereby increasing or decreasing the clamping pressure between the post receptacle 14 and the contact surface 68 when the shank 20 is in the closed position and the clamping mechanism is clamped on a body portion such as an ear lobe.

Figure 8:
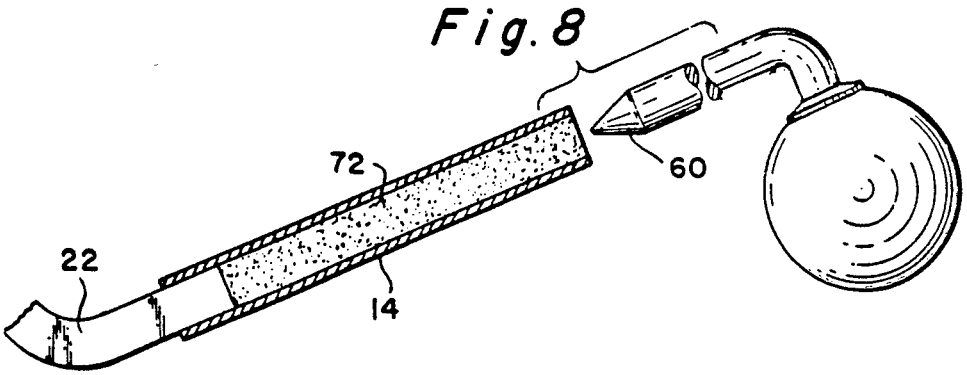
FIG. 8 is a cutaway, side perspective view of a second embodiment of the tubular post receptacle and means for securing an earring post in the receptacle.

Referring to FIG. 8, an alternative embodiment of the means for securing the earring post to the post receptacle is illustrated. As in the preferred embodiment, the alternative embodiment shown in FIG. 8 includes a spanning arm 22 affixed within the post receptacle 14. Unlike the preferred embodiment, the friction means for securing the earring post 60 in the post receptacle 14 is a yieldable and puncturable elastic material such as an adhesive 72 inserted within the post receptacle 14. The adhesive 72 is preferably a silicone glue, such as is commonly used in many household adhesive compounds. Embodiments of the invention sold by the inventor have used a silicone glue manufactured by the General Electric Company and sold under the name "Silicone Clear Household Glue & Seal". Insertion of an earring post 60 in the post receptacle 14 then displaces portions of the adhesive 72, creating a friction fit between the outer surface of the earring post 60 and the inner surface of the post receptacle 14, thereby securing the earring post 60 against longitudinal movement within the post receptacle 14.

Referring now FIGS. 9 through 13 an alternative embodiment of the invention is disclosed suitable for adapting pierced-ear earrings for use as a lapel pin. The construction employees a decorative portion 74 of a conventional pierced-ear earring. As best illustrated in FIG. 11, the decorative portion is attached to an earring post 76 containing a generally right angle bend 78. The right angle bend allows connection of the earring post 76 to a pin structure 80 adapted to pin the structure to apparel or garments. The pin structure can be configured in any of the conventional pin devices well known in the art, so long as they suitable for securely attaching the structure to apparel with a sharp pin. Preferably, the pin structure is compact so that relatively small decorative items can be attached to apparel without having the pin structure visible.

In the preferred embodiment, the pin structure comprises a pin end 82 having a point 83, and spring coil 84 along with a hook segment 86. The hook segment attaches to the spring coil 84 through a connecting portion 88. The spring coil urges the pin end 82 away from the connecting portion 88, and is held in proximity to the connecting portion by the hook segment 86. By that arrangement, the pin end 82 may be inserted into a garment and then secured by the hook segment against attachment from the apparel.

The pin structure in this embodiment of the invention is secured to a post receptacle 90, much like the post receptacle used in other embodiments of the invention. The post receptacle is generally linear and adapted to receive the earring post 76. To releasably secure the earring post within the post receptacle, the post receptacle contains an elastic material therein. The elastic material may be any elastic material so long as the elastic material secures to the post in a friction fit when the post is inserted into the post receptacle 90.

In the embodiment illustrated in FIGS. 9 through 13, the elastic material is a segment of tubing 92 inserted into the post receptacle 90. The tubing can be made of any elastic material, but is perfectly composed of a flexible material such as plastic or rubber. The plastic material typically used to coat electrical wires is a good example of such tubing. As best illustrated in FIG. 13, when the earring post 76 is inserted into the post receptacle 90 and the tubing 92 is contained therein, the earring post 76 is held firmly in place by the pressure of the contraction of the elastic material that composes the tubing 92.

The tubing 92 may be held within the post receptacle 92 by any of a number of well known means, such as gluing the tubing to the interior of the post receptacle, crimping one or more portions of the tubing, or narrowing the outer end of the post receptacle to form a lip such that the tubing 92 cannot slip past that end.

While preferred embodiments of the present invention have been set forth in the above detailed description, it is to be understood that the invention is limited only by the following claims and their equivalents.

What is claimed is:

1. A construction for adapting a standard pierced-ear earring for attachment to non-pierced ears when the pierced-ear earring is of the kind having a linear post for insertion through an ear lobe, the construction comprising, in combination:

a receptacle for the post, the receptacle being configured as a linear tube having a central linear bore and being adapted at one end to receive the earring post, the receptacle's bore containing an elastic material that compresses upon insertion of the post into the receptacle and retains the post within the receptacle by a friction fit; and means for clamping the receptacle to an ear lobe the means being configured as a spring clip that positions the receptacle parallel to the ear lobe, whereby the earring is attached to an ear without insertion of the post into the ear lobe.

2. A construction for adapting a standard pierced-ear earring for use as lapel pin when the pierce-ear earring is of the kind having a decorative portion attached to a linear post adapted for insertion through an ear lobe, the construction comprising, in combination:

a receptacle for the post, the receptacle being configured as a linear tube having a central linear bore having an opening at one end to receive the earring post, the receptacle's bore containing an elastic material that compresses upon insertion of the post into the receptacle and retains the post within the receptacle by a friction fit; and means for attaching the receptacle to apparel whereby the decorative portion is displayed in the apparel as a lapel pin.

3. An improved jewelry mounting construction for adapting a pierced-ear earring for use as a lapel pin, the earring being of the kind having an earring-post comprised of a generally linear shaft pointed at one end and affixed at the remaining end to a decorative item, the construction comprising, in combination:

means for receiving the pierced-ear earring post, the means comprising a post receptacle defining a generally cylindrical bore with a longitudinal axis in line with, parallel to, and compatible with the earring post and adapted for slidable insertion and removal of the earring post in and out of the bore at one end of the receptacle;

means for frictionally affixing the earring post within the post receptacle bore to restrain sliding insertion and removal of the earring post and attach the post within the bore, the means comprising a segment of compressible material inserted into the earring post receptacle bore and affixed longitudinally along a portion of the bore's inner surface so that insertion of the earring post into the bore compresses the compressible material and forces the post against both the compressible material and the bore's inner surface;

a means for pinning the post receptacle bore to an item of apparel, the means being compact and generally parallel to the post receptacle when the construction is attached to apparel, and affixed to the post receptacle such that the means does not extend substantially beyond the vicinity of the post receptacle, whereby a pierced-ear earring having a decorative attachment may be inserted by its earring post into the earring post receptacle and the post receptacle may be attached to clothing so that a pierced-ear earring may be used as a lapel pin.

* * * * *